United States Patent [19]

Iyori et al.

[11] Patent Number: 4,904,445

[45] Date of Patent: Feb. 27, 1990

[54] PROCESS FOR PRODUCING A TOUGH CERMET

[75] Inventors: Yusuke Iyori, Fukaya; Hisaaki Ida, Kumagaya, both of Japan

[73] Assignees: Hitachi Metals, Ltd., Tokyo; Hitachi Carbide Tools, Inc., Chiba, both of Japan

[21] Appl. No.: 172,237

[22] Filed: Mar. 23, 1988

Related U.S. Application Data

[63] Continuation-in-part of Ser. No. 869,716, Jun. 2, 1986, Pat. No. 4,778,521.

[30] Foreign Application Priority Data

Feb. 20, 1986 [JP] Japan ..... 61-35777

[51] Int. Cl.[4] ..... B22F 1/00

[52] U.S. Cl. ..... 419/13; 75/242; 75/244; 419/10; 419/16; 419/14; 419/33; 419/60; 419/39; 419/23

[58] Field of Search ..... 75/242, 244; 419/10, 419/13, 16, 33, 14, 60, 39, 23

[56] References Cited

U.S. PATENT DOCUMENTS 4,636,252 1/1987 Yoshimura et al. ..... 75/238

4,769,070 9/1988 Tobioka et al. ..... 75/238

*Primary Examiner*—Stephen J. Lechert, Jr.

*Assistant Examiner*—Nina Bhat

*Attorney, Agent, or Firm*—Finnegan, Henderson, Farabow, Garrett & Dunner

[57] ABSTRACT

A tough cermet made from 20–92 weight % of TiC and/or TiCN, 5–50 weight % of WC and 3–30 weight % of an iron-gorup metal. This tough cermet has a three phase grain microstructure and is made is mixing titanium carbonitride powder and up to 70 weight % of the total amount of the tungsten carbide fine powder. The resulting mixture is melted to form a solid solution, pulverized, mixed with the remaining amount of tungsten carbide fine powder, and sintered at temperatures of 1325°–1650° C.

2 Claims, 3 Drawing Sheets

PROCESS FOR PRODUCING A TOUGH CERMET

This application is a continuation-in-part application of Ser. No. 869,716 filed June 2, 1986, now U.S. Pat. No. 4778521.

BACKGROUND OF THE INVENTION

The present invention relates to tough TiCN and/or TiC cermets and more particularly to cermets having improved toughness due to their microstructural features.

In general, cermets comprise as ceramic components oxides, carbides, borides, nitrides, etc. of elements of the IVa, Va or VIa group of the Periodic Table and as binder components metals such as cobalt, nickel, molybdenum, etc. Among others, TiCN cermets, TiC cermets or TiCN-TiC cermets are useful because of their high wear resistance. Such cermets are generally made from TiCN and/or TiC, WC and binder metals.

Japanese Patent Publication No. 56-51201 discloses cemented carbonitride alloys consisting of carbonitrides of titanium, tungsten and other optional elements and binders of the iron-group groups. These cemented carbonitride alloys which may also be called simply cermets have a grain microstructure consisting of two phases: a carbonitride solid solution phase rich in titanium and nitrogen, and another hardening phase surrounding the above solid solution phase and rich in metal components of the VI group but scarce of nitrogen. Thus, the hardening phase forms a boundary phase which is in contact with a metal binder phase. Although the carbonitride solid solution phase has a poor wettability to the iron-group metals, the boundary phase surrounding the carbonitride solid solution phase is highly wettable with the iron-group metals. Therefore, the boundary phase serves to bond the carbonitride core phase and the metal binder phase.

This conventional cermet is prepared by first preparing a solid solution from titanium carbide, titanium nitride and tungsten carbide at high temperatures and high pressure, pulverizing it into fine powder after cooling, uniformly mixing carbonitride fine powder with binder metals, pressing the resulting mixture to form a green body, and sintering the green body at high temperatures. Why the two-phase grain microstructure appears is, according to the inventor of Japanese Patent Publication No. 56-51201, that a spinodal reaction takes place in carbonitride powder while simultaneously a diffusion reaction occurs in the liquified binder phase in the sintering process, resulting in the carbonitride phase surrounded by a carbide phase containing little nitrogen. The carbide phase forms a low-stress boundary phase in contact with the metal binder phase.

In this conventional cermet, the carbonitride core phase is hard and so has a high wear resistance, but it is brittle and so vulnerable to cracking. On the other hand, the boundary phase surrounding the carbonitride core phase has somewhat higher toughness but it is poor in wear resistance. Because the toughness of the surrounding boundary phase is not enough to stop the propagation of cracks from one core phase to another, cracks, once created, tend to grow rather straight within the entire body of the cermet, passing through the carbonitride core phase one after another. Microscopically speaking, a crack created in a carbonitride boundary phase cannot be stopped to propagate by the surrounding boundary phase because of high brittleness of the core phase and insufficiency in the toughness of the boundary phase, resulting in cracking in an adjacent core phase. This phenomenon takes place throughout the cermet, meaning that this cermet is not sufficiently tough despite its high wear resistance.

OBJECT AND SUMMARY OF THE INVENTION

Therefore, an object of the present invention is to provide a tough cermet free of disadvantages of the conventional one.

Another object of the present invention is to provide a tough cermet having a microstructure which prevents cracks from growing considerably straight within the entire body of the cermet.

A further object of the present invention is to provide a process for producing such a tough cermet.

In view of the above objects, the inventors have studied why the cermet of the above prior art is so vulnerable to cracking despite the fact that the carbonitride grains are bound by tough metals, and found that the above two-phase microstructure which is inherently produced by the above-mentioned process is responsible for the vulnerability to cracking. As a result, it has been found that a new cermet having a three-phase grain microstructure prepared by a new process is highly tough while retaining significant wear resistance.

That is, a tough cermet according to the present invention comprises 20–92 weight % of titanium carbide and/or titanium carbonitride, a 5–50 weight % of tungsten carbide and 3–30 weight % of a metal in the iron group, having a three-phase grain microstructure consisting of a core phase rich in titanium carbide and/or titanium carbonitride, an intermediate phase rich in tungsten carbide and surrounding the core phase, and an outer phase made of (titanium, tungsten) carbide and/or (titanium, tungsten) carbonitride and surrounding the intermediate phase. Part of titanium carbide and/or titanium carbonitride may be replaced by at least one compound selected from the group consisting of carbides, nitrides and carbonitrides of metal elements of the IVa, Va and VIa groups of the Periodic Table except for Ti and W, the amount of such compound being 30 weight % or less based on the total weight of the cermet. In this case, the cermet has a three-phase grain microstructure consisting of a core phase rich in titanium carbide and/or titanium carbonitride, an intermediate phase rich in tungsten carbide and surrounding the core phase, and an other phase surrounding the intermediate phase and made of at least one compound selected from the group consisting of carbides, nitrides and carbonitrides of metal elements of the VIa, Va and VIa groups of the Periodic Table inclusive of Ti and W.

A process for producing a tough cermet having a three-phase grain microstructure consisting of a core phase rich in titanium carbide and/or titanium carbonitride, an intermediate phase rich in tungsten carbide and surrounding the core phase, and an outer phase made of (titanium, tungsten) carbide and/or (titanium, tungsten) carbonitride and surrounding the intermediate phase according to the present invention comprises the steps of uniformly mixing 20–92 weight % of titanium carbide and/or titanium carbonitride powder, 5–50 weight % of WC fine powder and 3–30 weight % powder of a metal in the iron group, and sintering the mixture at temperatures of 1300°–1550° C. In this process, too, a part of titanium carbide and/or titanium carbonitride may be replaced by at least one compound selected from the group consisting of carbides, nitrides and carbonitrides of metal elements of the IVa, Va and VIa groups of the Periodic Table, the amount of such compound being 30 weight % or less based on the total weight of the cermet.

The present invention is based on the outstanding finding that the three-phase grain microstructure can be obtained by directly mixing titanium carbide and/or titanium carbonitride powder, tungsten carbide fine powder and metal powder and sintering the mixture without taking the course of forming a solid solution of titanium carbide and/or titanium carbonitride and tungsten carbide, pulverizing it to form (titanium, tungsten) carbonitride powder and sintering it with a metal binder, under the condition that the tungsten carbide powder is sufficiently fine. Instead, if the above-mentioned course which is described in Japanese Patent Publication No. 5651201 is followed, it would be impossible to prepare a tough cermet having the desired three-phase grain microstructure even with tungsten carbide fine powder.

Further, as a result of extensive research, it has been found that in the process of producing a tough cermet from titanium carbonitride powder, tungsten carbide fine powder and metal powder, part of the tungsten carbide fine powder should be used to form a solid solution of (Ti, W)CN, which is then pulverized and mixed with the remaining part of the tungsten carbide fine powder and sintered to provide the tough cermet with three-phase structure more stably. The amount of tungsten carbide fine powder to be added to titanium carbonitride powder to form a (Ti, W)CN solid solution should be, in general, up to 70% by weight of the total amount of tungsten carbide fine powder added. When it exceeds 70% by weight, the proportion of the intermediate phase becomes too small, virtually resulting in a two-phase cermet. Besides, the addition of WC exceeding 70% by weight to TiCN powder leads to the decrease in toughness of the resulting cermet. The preferred amount of tungsten carbide fine powder to be added to titanium carbonitride to form the solid solution is 30–60% by weight of the total amount of WC added.

DETAILED DESCRIPTION OF THE INVENTION

Figure 1:
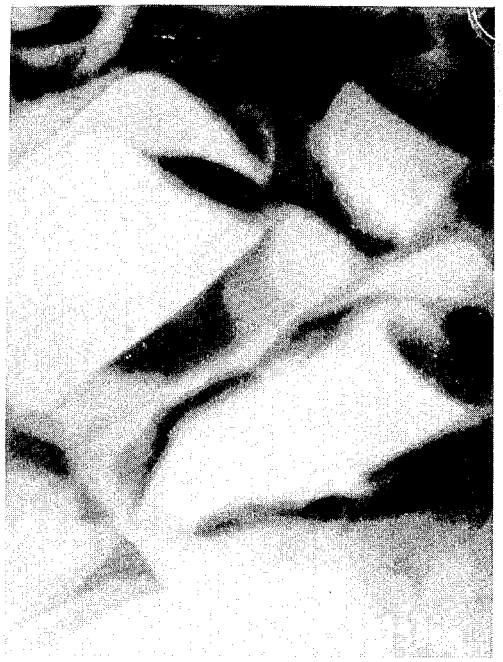
FIG. 1 is a STEM photomicrograph (x40,000) of the cermet of Example 1 according to the present invention.

The tough cermet according to the present invention comprises 20–92 weight % of titanium carbide and/or titanium carbonitride, 5–50 weight % of tungsten carbide and 3–30 weight % of an iron-group metal. The term "titanium carbonitride" used herein means a compound consisting of titanium, carbon and nitrogen. The titanium carbonitride may be prepared by melting titanium carbide and titanium nitride together to form their solid solution. Because any proportions of TiC and TiN can be formed into a solid solution, it should be understood that the titanium carbonitride may contain any proportions of carbon and nitrogen. However, for the purpose of simplicity, it is sometimes described as TiCN herein. Similarly, the term "tungsten carbide" used herein means a compound consisting of tungsten and carbon. Various ratios of carbon to tungsten are possible, but it is usually in the form of WC which is stable. Accordingly, it is sometimes described simply as WC herein. Among the iron-group metals used in the present invention as binder metals, nickel and cobalt are preferable. Nickel is the most preferable and it may be used with up to 50 weight % of cobalt.

The preferred ranges of the components are 45–80 weight % for TiC and/or TiCN, 7–30 weight % for WC and 13–25 weight % for the iron-group metal.

The cermet according to the present invention may contain at least one hardening compound selected from the group consisting of carbides, nitrides and carbonitrides of metal elements of the IVa, Va and VIa groups of the Periodic Table. This hardening compound or compounds may be substituted for TiC and/or TiCN in an amount of up to 30 weight % based on the total weight of the cermet. The preferred amount thereof is up to 20 weight %. The preferred hardening compound is molybdenum carbide which is stably in the form of $Mo_2C$.

The cermet according to the present invention is characterized by having a three-phase grain microstructure consisting of a core phase rich in TiC and/or TiCN, an intermediate phase rich in WC and surrounding the core phase and an outer phase made of (Ti,W)C and/or (Ti,W)CN and surrounding the intermediate phase. Accordingly, the core phase is rich in Ti but scarce of W, while the intermediate phase is rich in W but contains relatively little Ti. The outer phase is between the core phase and the intermediate phase with respect to the Ti and W contents. Because of the presence of the intermediate phase between the core phase and the outer phase, cracks tend to be prevented from penetrating through the core phase, winding through the intermediate and outer phases. This means that the cermet having the three-phase microstructure according to the present invention is less vulnerable to cracking. In other words, it shows high toughness.

The outer phase may contain at least one hardening compound selected from the group consisting of carbides, nitrides and carbonitrides of metal elements of the IVa, Va and VIa groups of the Periodic Table.

The cermet according to the present invention is prepared by uniformly mixing TiC and/or TiCN powder, WC fine powder and metal powder, and sintering the mixture at high temperatures.

What is important is that the WC powder should be as fine as less than 3 um in an average particle size. If the WC powder of 3 um or more is used, the resulting cermet has a microstructure which consists primarily of two phases. The reason therefor is not necessarily clear. However, given the facts that WC is highly soluble in nickel while TiCN is scarcely soluble therein, and that WC tends to precipitate on a particle surface, it is presumed that WC is preferentially concentrated around the TiC and/or TiCN particles when the WC powder is sufficiently fine. If the WC powder is inappropriately coarse, it would not be dissolved in the melted nickel completely, making it likely that WC precipitates around the remaining WC particles. This leads to the undesirable microstructure. The preferred average particle size of the WC powder is 2.5 um or less.

With respect to other components, the requirements of an average particle size are not so strict. In general, the TiC and/or TiCN powder may be 0.3–5 um, and it is preferably 0.5–3 um. Too large TiC and/or TiCN particles may result in too large grains in the resulting cermet, rendering it too brittle. The iron-group metal powder may have any average particle size because it is completely melted in the sintering process, but the preferred average particle size thereof is about 1–10 um to ensure the microstructural uniformness of the resulting cermet. The powder of carbide, nitride or carbonitride of a metal element of the IVa, Va or VIa group may have an average particle size of 0.3–5 um, preferably 0.3–3 um.

The powder ingredients are fully mixed in an alcohol solvent such as isopropyl alcohol, methylated alcohol, etc. To improve the pressing capability of the powder mixture, organic binders soluble in alcohol may be added. The preferred organic binder is wax, and its amount is usually 1–2 weight % based on the powder mixture. The mixing of the powder ingredients is usually carried out in a ball mill rotating at 100 r.p.m. or so for 50–100 hours. After drying in vacuum, the powder mixture is pressed at about 1–2 tons/cm$^2$. The resulting green body is sintered at temperatures of 1325°–1650° C., preferably 1400°–1500° C.

The present invention will be explained in further detail by the following Examples.

EXAMPLE 1

325g of TiCN powder (C/N ratio: 5/5) having an average particle size of 1.5 um, 100g of WC powder having an average particle size of 0.2–0.3 um, 55g of Ni powder having an average particle size of 2 um, and 20g of $Mo_2C$ Powder having an average particle powder of 2 um were mixed together with isopropyl alcohol in a ball mill rotating at 100 r.p.m. for 100 hours. The resulting uniform mixture was dried in vacuum at 80° C. for 10 hours, and pressed in a die at 1.5 tons/cm$^2$. The resulting green body was sintered at 1350–1450° C. in vacuum for 1 hour.

The cermet thus prepared was subjected to a scanning transmission electron microscopy (STEM). The STEM photomicrograph (x40,000) and the X-ray photomicrograph (x40,000) showing a tungsten distribution are shown in FIGS. 1 and 2, respectively.

Figure 2:
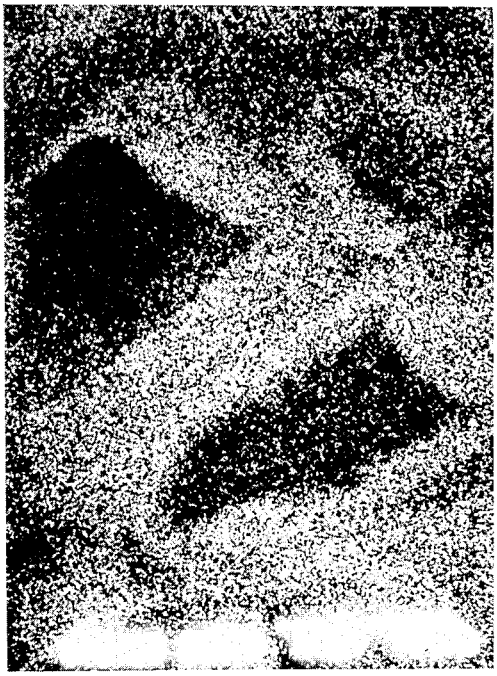
FIG. 2 is an X-ray photomicrograph of the same magnification of the cermet of FIG. 1.
Figure 3:
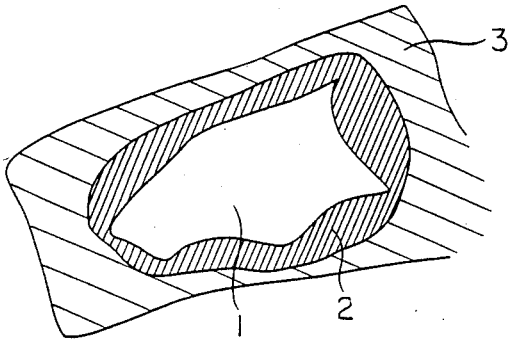
FIG. 3 is a schematic view of the microstructure as shown in FIG. 1.

FIG. 3 is a schematic view of the grain microstructure shown in FIG. 1. It is evident that the grain consists of a core phase 1, an intermediate phase 2 and an outer phase 3.

The composition of each phase was measured by a scanning transmission electron microscopy-energy dispersive X-ray spectrometer (STEM--EDX) analysis. The results are shown in Table 1.

TABLE 1

| Phase | Ti | W | Mo | Ni |
|---|---|---|---|---|
| Core Phase | 92.8 | 4.7 | 0.4 | 2.3 |
| Intermediate Phase | 43.4 | 41.7 | 11.3 | 3.5 |
| Outer Phase | 69.2 | 20.2 | 7.5 | 3.2 |

This analysis shows that the core phase is extremely rich in titanium but scarce of tungsten, while the intermediate phase contains less titanium and a lot more tungsten. It is interesting to note that the titanium content and the tungsten content of the outer phase are between those of the core phase and of the intermediate phase.

EXAMPLE 2

TiCN powder having an average particle size of 1.5 um, WC powder having an average particle size of 0.2–0.3 um, metal powder having an average particle size of 3 um and optional hardening compound powder having an average particle size of 2 um were mixed in various proportions as shown in Table 1. With isopropyl alcohol added, each of the mixture was subjected to thorough mixing in a ball mill rotating at 100 r.p.m. for 100 hours. The resulting uniform mixture was dried in vacuum at 80° C. for 10 hours, and pressed at 1.5 tons/cm$^2$. The resulting green body was sintered at 1350°–1450° C. in vacuum for 1 hour. This process will be called the present invention's process hereinbelow.

The same ingredients were also used for the conventional process. First, a mixture of the TiCN powder and the WC powder was prepared and melted to form a solid solution. The solid solution was pulverized and mixed with the metal powder and other optional hardening compound powder, and sintered under the same conditions as above.

The microstructures of all the cermets were observed by STEM. As a result, it has been confirmed that all the cermets prepared by the present invention's process have three-phase grain microstructures, while those prepared by the conventional process have two-phase grain microstructures. The results are shown in Table 2 in which A and B mean three-phase and two-phase grain microstructures, respectively.

Next, they were measured with respect to bending strength, fracture toughness and hardness. The results are shown in Table 3 in which A and B have the same meaning as in Table 2.

It is evident from Table 3 that the cermets of the present invention designated by the symbol A which have the three-phase grain microstructure are almost the same as those designated by the symbol B and having the two-phase grain microstructure with respect to hardness, but are superior to them with respect to both bending strength and fracture toughness. Particularly with respect to these two properties, they are improved more than 40% at maximum for the cermets of the same composition.

TABLE 2

| No. | TiCN | WC | Ni | Co | Hardening Compound | C/N |
|---|---|---|---|---|---|---|
| 1A<br>1B | 95 | 2 | 3 | 0 | 0 | 5/5 |
| 2A*<br>2B | 92 | 5 | 3 | 0 | 0 | 5/5 |
| 3A*<br>3B | 65 | 20 | 15 | 0 | 0 | 5/5 |
| 4A*<br>4B | 50 | 20 | 30 | 0 | 0 | 5/5 |

TABLE 2-continued

| No. | TiCN | WC | Ni | Co | Hardening Compound | C/N |
|---|---|---|---|---|---|---|
| 5A | 40 | 20 | 40 | 0 | 0 | 5/5 |
| 5B | | | | | | |
| 6A* | 40 | 50 | 10 | 0 | 0 | 5/5 |
| 6B | | | | | | |
| 7A | 30 | 60 | 10 | 0 | 0 | 5/5 |
| 7B | | | | | | |
| 8A* | 20 | 50 | 30 | 0 | 0 | 5/5 |
| 8B | | | | | | |
| 9A* | 65 | 20 | 10 | 0 | HfC:5 | 5/5 |
| 9B | | | | | | |
| 10A* | 60 | 20 | 10 | 0 | TaCN:10 | 5/5 |
| 10B | | | | | | |
| 11A* | 50 | 25 | 15 | 0 | NbC:10 | 9/1 |
| 12A* | | | | | | 7/3 |
| 13A* | 70 | 20 | 5 | 5 | 0 | 9/1 |
| 13B | | | | | | |
| 14A* | 60 | 20 | 5 | 5 | TaC:10 | 7/3 |
| 14B | | | | | | |
| 15A* | 70 | 20 | 10 | 0 | 0 | 10/0 |
| 15B | | | | | | |
| 16A* | 70 | 20 | 7 | 3 | 0 | 9/1 |

Note:
(1) unit: weight %
(2) A and B show three-phase and two-phase grain microstructures, respectively.
(3) *shows the present invention.

TABLE 3

| No. | Bending Strength ($kg/mm^2$) | Fracture Toughness ($MN/m^{3/2}$) | Hardness ($H_RA$) |
|---|---|---|---|
| 1A | 135 | 12.3 | 94.1 |
| 1B | 130 | 12.1 | 94.0 |
| 2A* | 189 | 17.3 | 94.0 |
| 2B | 134 | 12.3 | 93.8 |
| 3A* | 294 | 20.5 | 90.8 |
| 3B | 225 | 17.8 | 90.5 |
| 4A* | 318 | 21.8 | 89.8 |
| 4B | 232 | 17.9 | 89.5 |
| 5A | 310 | 21.5 | 87.3 |
| 5B | 308 | 21.3 | 87.0 |
| 6A* | 292 | 20.8 | 89.8 |
| 6B | 208 | 17.9 | 89.5 |
| 7A | 285 | 20.7 | 87.5 |
| 7B | 284 | 20.6 | 87.4 |
| 8A* | 320 | 21.8 | 89.2 |
| 8B | 225 | 17.5 | 88.5 |
| 9A* | 279 | 20.1 | 88.3 |
| 9B | 203 | 17.3 | 88.0 |
| 10A* | 275 | 20.0 | 90.7 |
| 10B | 200 | 17.0 | 90.3 |
| 11A* | 270 | 20.0 | 91.2 |
| 12A* | 275 | 20.3 | 91.4 |
| 13A* | 208 | 16.9 | 94.3 |
| 13B | 132 | 13.7 | 94.2 |
| 14A* | 212 | 17.2 | 94.2 |
| 14B | 141 | 13.0 | 94.0 |
| 15A* | 222 | 18.3 | 93.9 |
| 15B | 143 | 11.8 | 93.8 |
| 16A* | 210 | 17.0 | 94.1 |
| 16B | 139 | 12.8 | 93.7 |

Note:
(1) A and B show three-phase and two-pahse grain microstructures, respectively.
(2) *shows the present invention.

Figure 8:
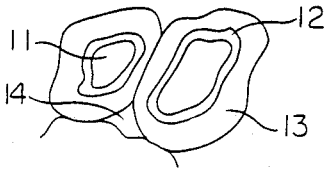
FIG. 8 is a schematic view of the microstructure of the cermet (Sample No. 3A)
Figure 9:
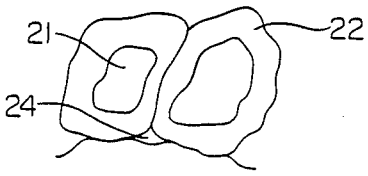
FIG. 9 is a schematic view of the microstructure of the cermet (Sample No. 3B)
Figure 4:
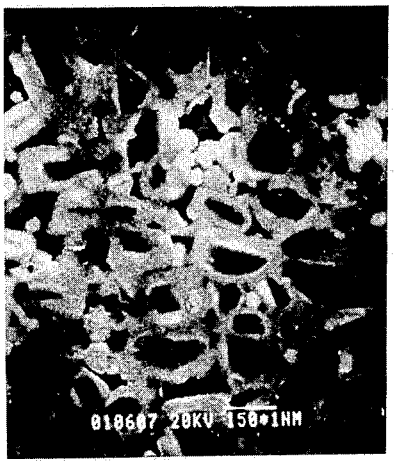
FIG. 4 is a STEM photomicrograph (x5,000) of the cermet (Sample No. 3A)
Figure 6:
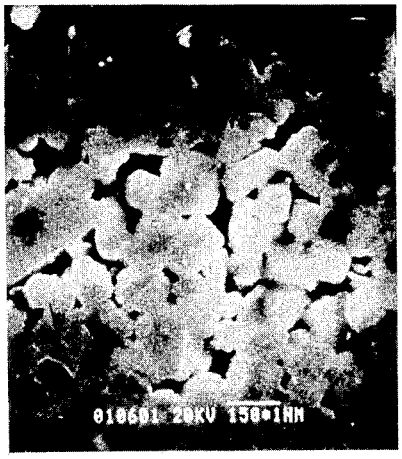
FIG. 6 is a STEM photomicrograph (x5,000) of the cermet (Sample No. 3B)

FIGS. 4 and 6 show the microstructures of the samples 3A and 3B. It is observed that the sample 3A has the three-phase grain microstructure and the sample 3B has the two-phase grain micro-structure. These three-phase and two-phase microstructures are schematically shown in FIGS. 8 and 9, respectively. In FIG. 8, 11 denotes a core phase, 12 an intermediate phase, 13 an outer phase, and 14 a binder phase. In FIG. 9, 12, 22 and 24 denote a core phase, an outer phase and a binder phase, respectively.

Figure 5:
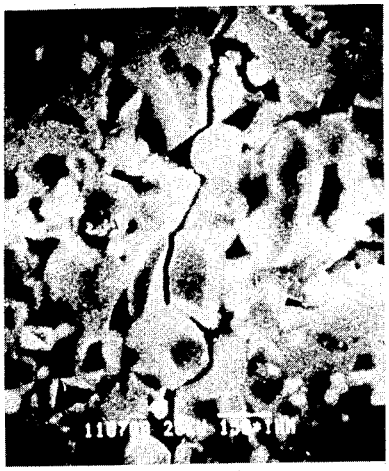
FIG. 5 is a STEM photomicrograph (x5,000) of the fractured cermet (Sample No. 3A)
Figure 7:
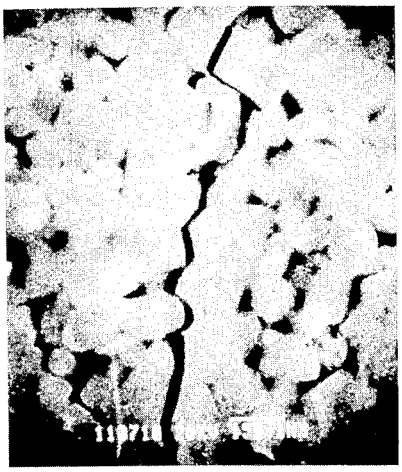
FIG. 7 is a STEM photomicrograph (x5,000) of the fractured cermet (Sample No. 3B)

The cermets of the samples 3A and 3B were subjected to a fracture test. FIGS. 5 and 7 show the fractured samples 3A and 3B of FIGS. 4 and 6, respectively. It is evident from the comparison between FIGS. 5 and 7 that in the two-phase microstructure, cracks run rather straight in the cermet while in the three-phase microstructure, cracks run windingly in the cermet. This difference seems to be due to the fact that the three-phase microstructure prevents cracks from penetrating the core phase so that they propagate in the WC-rich intermediate phase or the other phase, thus absorbing or consuming larger energy which may otherwise serve to break the cermets.

With respect to the samples 1A and 1B, the WC content is only 2 weight %, so that no substantial difference is appreciated between them with respect to the mechanical properties. The sample 1A contains a very small amount of WC, so the WC-rich phase is extremely small, rendering the overall microstructure rather similar to the two-phase one. Further, because the sample 1A contains TiCN in excess, it is extremely lower than the other samples of the present invention with respect to both bending strength and fracture toughness, despite its high hardness.

With respect to the samples 5A and 5B, no substantial difference in the mechanical properties is appreciated between them, because they contain an excessive amount of Ni as a binder rendering them relatively soft so that the difference in the microstructure is much less significant.

With respect to the samples 7A and 7B, they contain as much as 60% by weight of WC. As a result, excess of WC intrudes into the surrounding outer phase, rendering the grain microstructure rather similar to the two-phase one.

With respect to the samples 9A-12A and 14A, they contain HfC, TaCN, NbC and TaC as hardening compounds. It has been observed that all of them have the three-phase grain microstructure so that they have also high toughness.

Further with respect to the samples 11A and 12A, they have almost the same mechanical properties despite the difference in the carbon to nitrogen ratio.

EXAMPLE 3

The same experiments as in Example 2 were repeated on the starting materials of the compositions as shown in Table 4. The same procedures were followed as in Example 2 to prepare cermets. The cermets were measured with respect to microstructure, bending strength and fracture toughness. The results are shown in Table 5.

It has been further found as a result of extensive research that in the process of producing a tough cermet from titanium carbonitride powder, tungsten carbide fine powder and metal powder, part of the tungsten carbide fine powder should be used to form a solid solution of (Ti, W)CN, which is then pulverized and mixed with the remaining part of the tungsten carbide fine powder and sintered to provide the tough cermet with three-phase structure more stably. The amount of tungsten carbide fine powder to be added to titanium carbonitride powder to form a (Ti, W)CN solid solution should be, in general, up to 70% by weight of the total amount of tungsten carbide fine powder added. When it exceeds 70% by weight, the proportion of the intermediate phase becomes too small, virtually resulting in a two-phase cermet. Besides, the addition of WC exceeding 70% by weight to TiCN powder leads to the decrease in toughness of the resulting cermet. The preferred amount of tungsten carbide fine powder to be added to titanium carbonitride to form the solid solution is 30–60% by weight of the total amount of WC added.

EXAMPLE 4

47% by weight of TiCN powder (C/N ratio: 6/4) having an average particle size of 1.5 um, 30% by weight of WC powder having an average particle size of 0.2–0.3 um and 10% by weight of $Mo_2C$ powder having an average particle size of 3 um and 13 weight % of Ni powder having an average particle size of 1.2 um were used to prepare a cermet. First, part of the WC powder was added to the TiCN powder, uniformly mixed, and then melted to form a solid solution of (Ti, W)CN. This (Ti, W)CN solid solution was pulverized to an average particle size of 1.4 um, and then uniformly mixed with the remaining amount of the WC powder and the $Mo_2C$ powder and the Ni powder. The mixture was sintered at 1400° C. in vacuum for 1 hour. The resulting cermet was measured with respect to the proportion of the intermediate phase and bending strength. The same experiments were repeated for various amounts of the WC powder added to the TiCN powder. The results are shown in FIG. 10.

Figure 10:
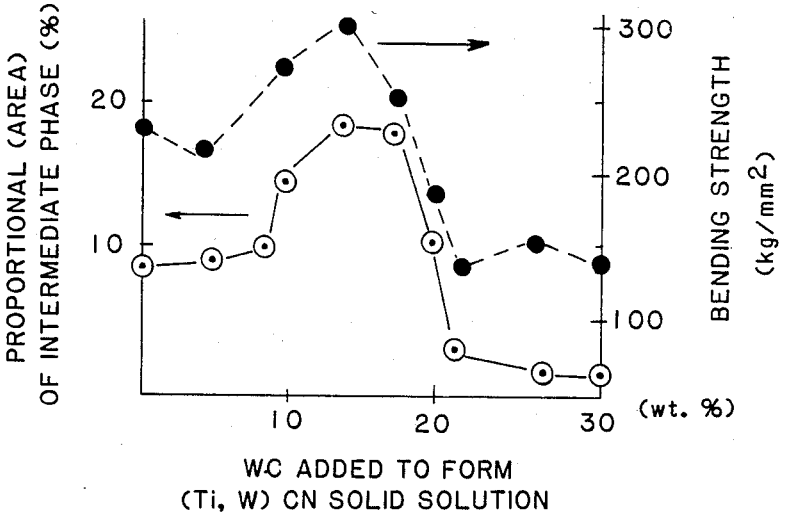
FIG. 10 is a graph illustrating the relationship of the intermediate phase and bending strength of the cermet to the amount of WC powder added to form a sold solution of (Ti, W)CN.

It is clear from FIG. 10 that when the amount of the WC powder added to the TiCN powder exceeds 30% by weight, which means more than 70% by weight of the total amount of the WC powder is added to the TiCN powder to form a solid solution of (Ti, W)CN, the proportion of the intermediate phase and the bending strength decrease drastically.

As is apparent from the above, the cermets of the present invention have much higher bending strength and fracture toughness than those of the conventional cermets without sacrificing wear resistance and hardness. Accordingly, they are very useful not only for machine tools but also for parts and members which should have high wear resistance and toughness.

The present invention has been explained specifically by the examples, but it should be noted that it is not limited thereto and that any modifications are possible as long as they are within the scope of the claims attached hereto.

TABLE 4

| | TiCN | | | WC | | Ni | $Mo_2C$ | |
|---|---|---|---|---|---|---|---|---|
| No. | C/N | wt. % | um | wt. % | um | wt. % | wt. % | um |
| 1* | 9/1 | 67 | 1.5 | 20 | 0.1 | 12 | 1 | 1.5 |
| 2* | 9/1 | 67 | 1.5 | 20 | 0.3 | 12 | 1 | 1.5 |
| 3* | 9/1 | 67 | 1.5 | 20 | 0.5 | 12 | 1 | 1.5 |

TABLE 4-continued

| | TiCN | | | WC | | Ni | $Mo_2C$ | |
|---|---|---|---|---|---|---|---|---|
| No. | C/N | wt. % | um | wt. % | um | wt. % | wt. % | um |
| 4* | 9/1 | 67 | 1.5 | 20 | 1.0 | 12 | 1 | 1.5 |
| 5* | 9/1 | 67 | 1.5 | 20 | 1.5 | 12 | 1 | 1.5 |
| 6 | 9/1 | 67 | 1.5 | 20 | 2.0 | 12 | 1 | 1.5 |
| 7* | 7/3 | 65 | 2.5 | 25 | 1.0 | 8 | 2 | 0.8 |
| 8* | 7/3 | 65 | 2.5 | 25 | 1.5 | 8 | 2 | 0.8 |
| 9 | 7/3 | 65 | 2.5 | 25 | 3.0 | 8 | 2 | 0.8 |

Note:
*shows the present invention.

TABLE 5

| No. | Grain Microstructure | Bending Strength ($kg/mm^2$) | Fracture Toughness ($MN/m^{3/2}$) |
|---|---|---|---|
| 1 | Three Phase | 244 | 18.2 |
| 2 | Three Phase | 252 | 18.0 |
| 3 | Three Phase | 238 | 17.8 |
| 4 | Three Phase | 228 | 17.7 |
| 5 | Three Phase | 220 | 17.6 |
| 6 | Primarily Two Phase | 148 | 12.3 |
| 7 | Three Phase | 223 | 16.9 |
| 8 | Three Phase | 208 | 16.5 |
| 9 | Primarily Two Phase | 132 | 12.0 |

What is claimed is:

1. A process for producing a tough cermet having a three-phase grain microstructure consisting of a core phase rich in titanium carbonitride, an intermediate phase rich in tungsten carbide surrounding said core phase, and an outer phase of a (titanium, tungsten) carbonitride solid solution surrounding said intermediate phase, the tough cermet including from 20–92% by weight of titanium carbonitride powder, 5–50% by weight of tungsten carbide fine powder and 3–30% by weight of metal powder in the iron group, the process comprising the steps of:

(a) uniformly mixing the titanium carbonitride powder and up to 70% by weight of the total amount of the tungsten carbide fine powder, (b) melting the resulting mixture to form a solid solution of (titanium, tungsten) carbonitride, (c) pulverizing said solid solution, (d) uniformly mixing the resulting (titanium, tungsten) carbonitride powder with the remaining amount of tungsten carbide fine powder, and (e) sintering the mixture at temperatures of 1325°–1650° C.

2. The process as recited in claim 1, wherein between 30–60 weight % of the total amount of tungsten carbide fine powder is mixed with the titanium carbonitride powder in step (a).

* * * * *